US005176505A

United States Patent [19]

Horii et al.

[11] Patent Number: 5,176,505

[45] Date of Patent: Jan. 5, 1993

[54] OIL-COOLED COMPRESSOR

[75] Inventors: Tsutomu Horii, Kakogawa; Kazuo Kubo, Kobe; Masaki Matsukuma, Kobe; Terumasa Kume, Kobe, all of Japan

[73] Assignee: Kabushiki Kaisha Kobe Seiko Sho, Kobe, Japan

[21] Appl. No.: 732,926

[22] Filed: Jul. 19, 1991

[30] Foreign Application Priority Data

Aug. 31, 1990 [JP] Japan ..... 2-232185
May 2, 1991 [JP] Japan ..... 3-100967

[51] Int. Cl.[5] ..... F04C 29/02

[52] U.S. Cl. ..... 417/295; 418/100; 418/DIG. 1

[58] Field of Search ..... 417/295; 418/88, 97, 418/98, 99, 100, DIG. 1, 201.2

[56] References Cited

U.S. PATENT DOCUMENTS

| | | | |
|---|---|---|---|
| 3,073,513 | 1/1963 | Bailey | 418/99 X |
| 3,073,514 | 1/1963 | Bailey | 418/201.2 X |
| 4,472,121 | 9/1984 | Tanaka et al. | 418/88 X |
| 4,518,330 | 5/1985 | Asami et al. | 418/88 X |
| 4,758,138 | 7/1988 | Timuska | 418/100 |
| 5,033,944 | 7/1991 | Lassota | 418/100 X |

FOREIGN PATENT DOCUMENTS

| | | | |
|---|---|---|---|
| 191490 | 11/1982 | Japan | 418/DIG. 1 |
| 581324 | 11/1977 | U.S.S.R. | 418/98 |
| 628340 | 10/1978 | U.S.S.R. | 418/88 |
| 1153123 | 4/1985 | U.S.S.R. | 418/88 |
| 1236173 | 6/1986 | U.S.S.R. | 418/97 |
| 1293080 | 10/1972 | United Kingdom | 418/97 |
| 2008684 | 6/1979 | United Kingdom | 418/DIG. 1 |

*Primary Examiner*—Leonard E. Smith
*Attorney, Agent, or Firm*—Oblon, Spivak, McClelland, Maier & Neustadt

[57] ABSTRACT

To enable the prevention of smearing an equipment and its periphery with lubricating oil, the alleviation of a burden in maintenance of the equipment by reducing a decrement of the lubricating oil, and the lowering of running cost, an oil-cooled compressor has a suction control valve 5 in a suction passage 3 and an air discharge valve 9 in a discharge passage 6 in a compressor body 1. An oil discharge passage 16 is formed for leading outside the lubricating oil supplied to bearing and shaft seal sections of the compressor body 1, an oil return passage 17 communicating with the inlet side of the suction control valve 5, an oil reservoir section 18 located between the oil discharge passage 16 and the oil return passage 17; and an air discharge passage 19 arranged with one end connected to the outlet port of the air discharge valve 9 and its another end reaching the oil reservoir section 18. The lubricating oil is sent out towards the inlet side of the suction control valve 5 through the oil return passage 17 without reverse flow of the oil from the oil reservoir section 18 into the oil discharge passage 16.

4 Claims, 3 Drawing Sheets

OIL-COOLED COMPRESSOR

BACKGROUND OF THE INVENTION

1. Field of the Invention

This invention relates to an oil-cooled compressor having a suction control valve in a suction passage formed in a compressor body, and a discharge valve in a discharge passage.

2. Description of the Related Art

An oil-cooled compressor designed to compress an air with a lubricating oil cooled for the purpose of cooling a compressed air and sealing a clearance in a compression space has been widely known. This type of compressor is the same as other types of compressors in the respect that the supply of lubricating oil to each part of rotor shaft bearings and shaft seal sections is required for lubrication to bearings of a shaft of a rotor for air compression, and for prevention of air leakage at shaft seal sections. To each of these sections the lubricating oil is supplied separately.

In the aforementioned oil-cooled compressor, a rotor shaft is installed with at least one of its end sections, four example four end sections in the case of a screw compressor, mounted through a casing of the compressor body in order to receive a driving power from a motor. Between this section of the rotor shaft and the casing is provided a shaft seal section for sealing a clearance communicating with the outside.

To this shaft seal section, as described above, the lubricating oil is supplied separately from the compression space and the bearing sections. However, since the rotor shaft is a rotating part, the clearance between the rotor shaft and the shaft seal section can not be fully eliminated; there exists a slight clearance around the rotor shaft. The lubricating oil supplied to the shaft seal section will leak little by little through the clearance with the lapse of time. The oil, if left leaking, will, together with dust, soil the interior of a package containing the equipment and the floor. It, therefore, presents such a problem that installation of a discharge pipe will be required for discharging the leaking oil out of the equipment.

The discharge of the leaking oil, therefore, presents another problem that regular replenishment of lubricating oil circulating within the equipment will become necessary, thus requiring more manhours for equipment maintenance work. Furthermore the lubricating oil itself is improved in durability and accordingly becomes costly, hence causing an increase in running cost.

SUMMARY OF THE INVENTION

The present invention has been accomplished in an attempt to solve the problems mentioned above. And its object resides in providing an oil-cooled compressor capable of preventing the soiling with lubricating oil of the equipment and peripheral parts, alleviating burden in equipment maintenance work by decreasing the amount of leaking lubricating oil, and lowering the running cost.

In order to solve these problems a first invention provides an oil-cooled compressor having a suction control valve installed in a suction passage of a compressor body and an air discharge valve installed in a discharge passage. This oil-cooled compressor is formed by providing an oil discharge passage for leading outside a lubricating oil that has been supplied to bearings and shaft seals in the compressor, an oil return passage communicating with the inlet side of the suction control valve, an oil reservoir section disposed between the oil discharge passage and the oil return passage, and an air discharge passage with its one end connected to the outlet of the air discharge valve and with its another end reaching the oil reservoir section so that the air can be sent out to the inlet side of the suction control valve through inside the oil return passage without reverse flow of the lubricating oil from the oil reservoir into the oil discharge passage.

A second invention provides an oil-cooled compressor comprising a suction control valve mounted in the suction passage of the compressor and an air discharge valve mounted in the discharge passage. This oil-cooled compressor is formed by providing an oil discharge passage for leading outside the lubricating oil supplied to bearings and shaft seals used in the compressor, an oil return passage connected to an extended section of a suction passage extending from the suction filter to the suction control valve, on the opposite side of a suction filter mounted on the inlet side of the suction control valve, an oil reservoir section between the oil discharge passage and the oil return passage, an oil separating means mounted between the suction control valve and the suction filter, an oil reservoir section between the oil discharge passage and the oil return passage, and an air discharge passage with its one end connected to the outlet of the air discharge valve and its another end reaching the oil reservoir section so that the air can be sent out to the inlet side of the suction control valve through inside the oil return passage without allowing reverse flow of the lubricating oil from the oil reservoir into the oil discharge passage.

According to the oil-cooled compressor constituted as the first invention, the lubricating oil leaking at bearings and shaft seals out of the compressor is automatically returned to the suction control valve side for recirculation, at the time of air discharge, without performing a maintenance work for collection of oil and also without discarding the oil that has leaked.

Furthermore, the oil-cooled compressor constituted as the second invention, in addition to the function of the first invention, is designed to check the flow of the oil towards the suction filter sides by the use of the oil separating means even when the separation of the discharge air coming to the vicinity of the suction control valve from the oil return passage from the oil is done incompletely.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Next, the oil-cooled compressor of the first embodiment according to the present invention will be explained with reference to the drawings.

Figure 1:
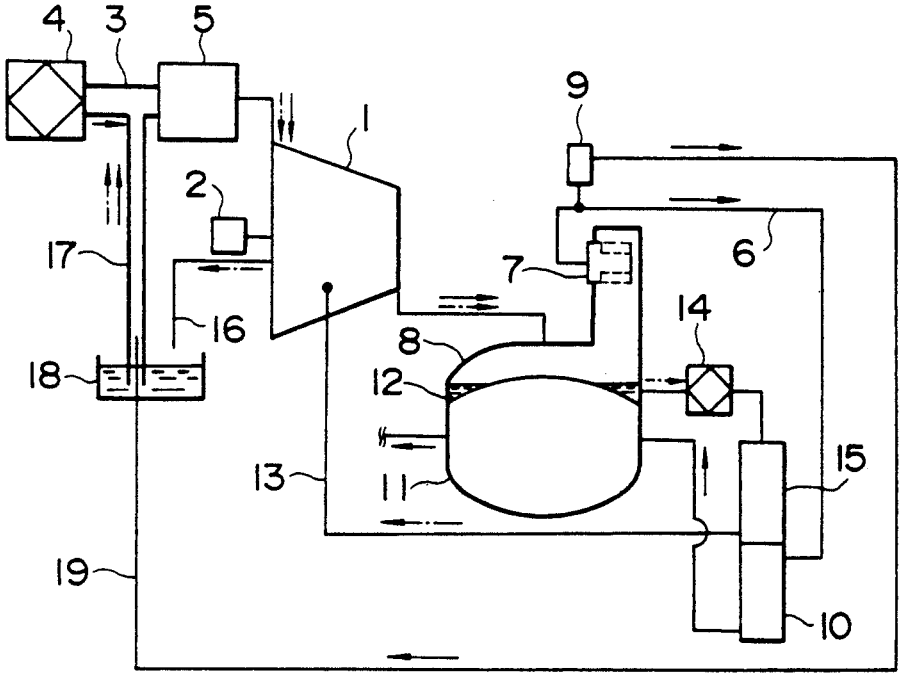
FIG. 1 is a general block diagram of an oil-cooled compressor of a first embodiment according to the present invention.

FIG. 1 shows the oil-cooled compressor of the first embodiment according to the first invention. This compressor comprises a compressor body 1; a motor 2; a suction filter 4 and suction control valve 5 mounted in a suction passage 3 reaching the suction port of the compressor body 1; an oil tank 8 having an oil separating element 7, an air discharge valve 9, an after cooler 10, and a reservoir tank 11 which are mounted in the discharge passage connected to the discharge port of the compressor body 1; and an oil filter 14 and an oil cooler 15 in a lubricating oil circulation passage 13 extending from a first oil reservoir 12 in the lower part of the oil tank 8 to such lubrication points not illustrated as the compression space, bearings and shaft seal sections in the compressor body 1.

Furthermore, the equipment is provided with an oil discharge passage 16 for leading outside the lubricating oil supplied to the bearings and shaft seal sections in the compressor body 1, an oil return passage 17 communicating to the inlet side of the suction control valve 5, a second oil reservoir 18 between the oil discharge passage 16 and the oil return passage 17, and an air discharge passage 19 with its one end connected to the outlet of the air discharge valve 9 and its another end reaching the second oil reservoir 18 to send out the air toward the inlet side of the suction control valve 5 within the oil return passage 17 without reverse flow of the lubricating oil from the second oil reservoir 18 into the oil discharge passage 16.

In the drawing, the arrow marks along full lines indicate the flow of air, while the arrow marks along alternate long and short dash lines indicate the flow of the lubricating oil.

Next, the operation of the equipment of the aforementioned constitution will be explained.

The compressor 1 is driven by power from the motor 2, with the result that the air is drawn into the compressor 1 via the suction filter 4 and the suction control valve 5 in the suction passage 3, compressed together with the lubricating oil supplied through the lubricating oil circulating passage 13, and discharged into the discharge passage 6. The compressed air thus discharged together with the lubricating oil is separated from the lubricating oil by means of the oil separating element in the oil tank 8, and is sent into the discharge passage 6 connected to the outlet side of the oil separating element 7, while the lubricating oil separated drips down, being once reserved in the first oil reservoir 12 located in the lower part of the oil tank.

The compressed air that has come out of the oil separating element 7 into the discharge passage 6 is cooled by the after cooler 10, then once reserved in the reservoir tank 11. Thereafter the compressed air is delivered from the reservoir tank 11 in accordance with a user's demand.

On the other hand, the lubricating oil in the first oil reservoir 12 flows through the oil filter 14 to the oil cooler 15, where the oil is cooled. The oil thus cooled is supplied to the compression space, bearings and shaft seals in the compressor body 1, and then discharged together with the compressed air into the discharge passage 6 as described above, being circulated thereafter.

The lubricating oil, though circulated, will leak out of the compressor body 1 as described above; and therefore the oil will be once led into the second oil reservoir 18 through the oil discharge passage 16.

In the meantime, when the equipment is stopped, for example after the end of operation, the air discharge valve 9 is generally opened to discharge the compressed air out from the discharge passage 6. Therefore, this equipment is formed so as to lead the compressed air thus discharged through the air discharge passage 19 to the oil return passage 17 of the second oil reservoir 18. Then by utilizing a negative pressure built up in the oil return passage 17 by the compressed air being discharged with force from the oil return passage 17, or by utilizing the principle of a so-called atomizer, the lubricating oil in the second oil reservoir 18 is sent out, together with the compressed air thus discharged, to the inlet side of the suction control valve 5, without reversing the flow of the lubricating oil from the second oil reservoir 18 into the oil discharge passage 16. The lubricating oil thus sent out to the inlet side is drawn, together with the air, into the compressor body 1 at the time of restarting of the equipment, being recirculated, so that all the lubricating oil that has leaked out of the compressor body 1 can be effectively reused without being discarded, thus dispensing with maintenance operation such as replenishment of the lubricating oil.

Figure 2:
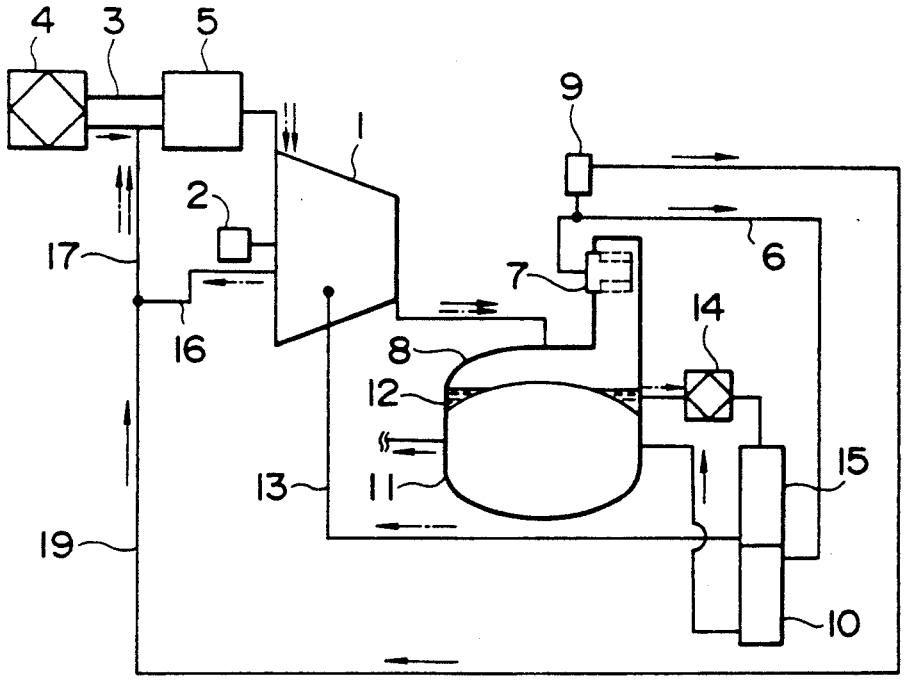
FIG. 2 is a general block diagram of an oil-cooled compressor of a second embodiment according to the present invention.
Figure 3:
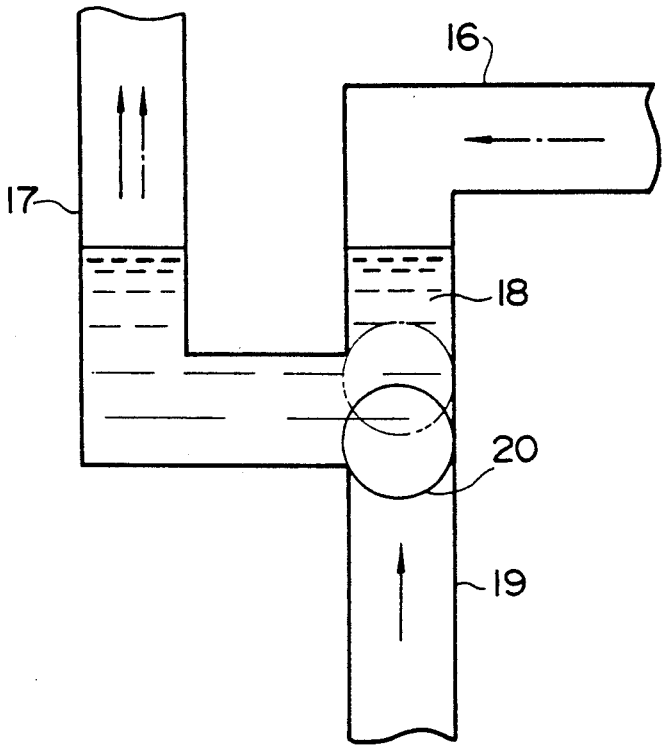
FIG. 3 is a partly enlarged sectional view of a second oil reservoir section of the equipment shown in FIG. 2 and its peripheral section.

FIGS. 2 and 3 show the oil-cooled compressor of the second embodiment according to the first invention, which is substantially the same in constitution as the equipment shown in FIG. 1 except a difference in the lubricating oil delivery structure of the second oil reservoir 18. The same reference numerals are used for corresponding parts, which, therefore, will not be explained.

In the second embodiment, the oil discharge passage 16 and the oil return passage 17 meet in a downstream position, forming the second oil reservoir 18 at this junction. The air discharge passage 19 is connected to the lower part of the oil return passage 17 at the junction. At this connection is disposed a ball 20 functioning as a check valve.

This ball 20 functions to prevent the flow of the lubricating oil from the second oil reservoir 18 into the air discharge passage 19 and the reverse flow of the oil, by the compressed air, from the air discharge passage 19 into the oil discharge passage 16, thus sending the oil from the oil return passage 17 to the inlet side of the suction control valve 5.

Figure 4:
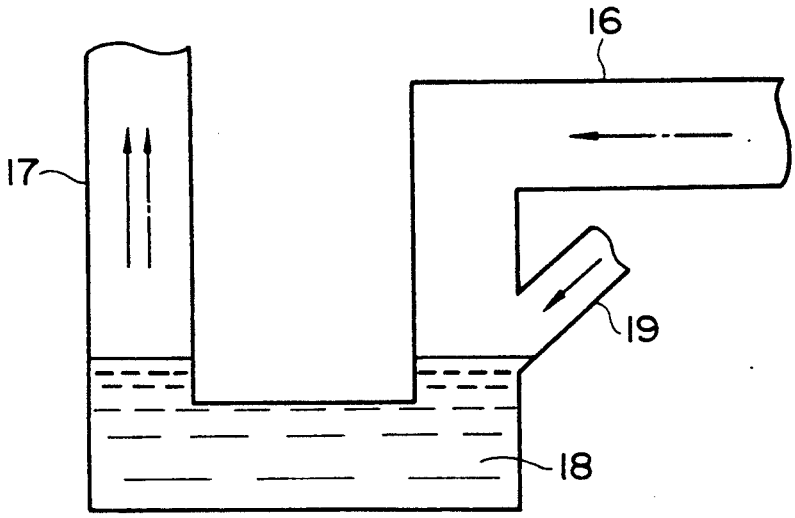
FIG. 4 is a partly enlarged sectional view showing a variation of the part shown in FIG. 3.

Furthermore, the air discharge passage 19 may be connected, in place of the use of the ball 20, to the oil discharge passage 16 in a downward direction at the upstream side of the second oil reservoir 18 as shown in FIG. 4, so that the lubricating oil will be sent out from above towards the oil return passage 17.

Figure 5:
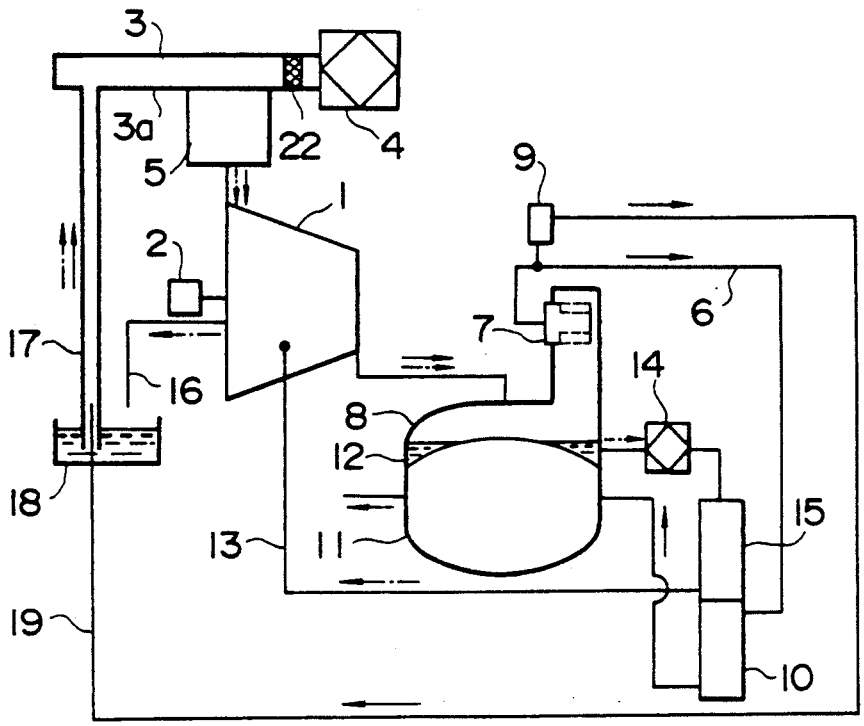
FIG. 5 is a general block diagram of the oil-cooled compressor of the first embodiment according to the second invention.

FIG. 5 shows the oil-cooled compressor of the first embodiment according to the second invention, which has substantially the same constitution as the equipment shown in FIG. 1, except the suction control valve 5, the suction filter 4, and the oil return passage 16; it should be noted that the same members as those in FIG. 1 are designated by the same reference numerals and will not be explained herein.

In the present embodiment, the oil return passage 17 communicates with an extended section 3*a* extending on the opposite side of the suction filter 4 mounted in the suction passage 3 between the suction filter 4 mounted on the inlet side of the suction control valve 5 and the suction control valve 5. Furthermore, a mesh 22 which is one example of a means for oil separation is mounted between the suction control valve 5 and the suction filter 4. Oil flowing from the oil return passage 17 towards the filter 4 side due to insufficient separation of the discharge air from the oil will be trapped by this mesh 22, whereby oil leakage at the suction filter 4 out the compressor can be prevented.

Figure 6:
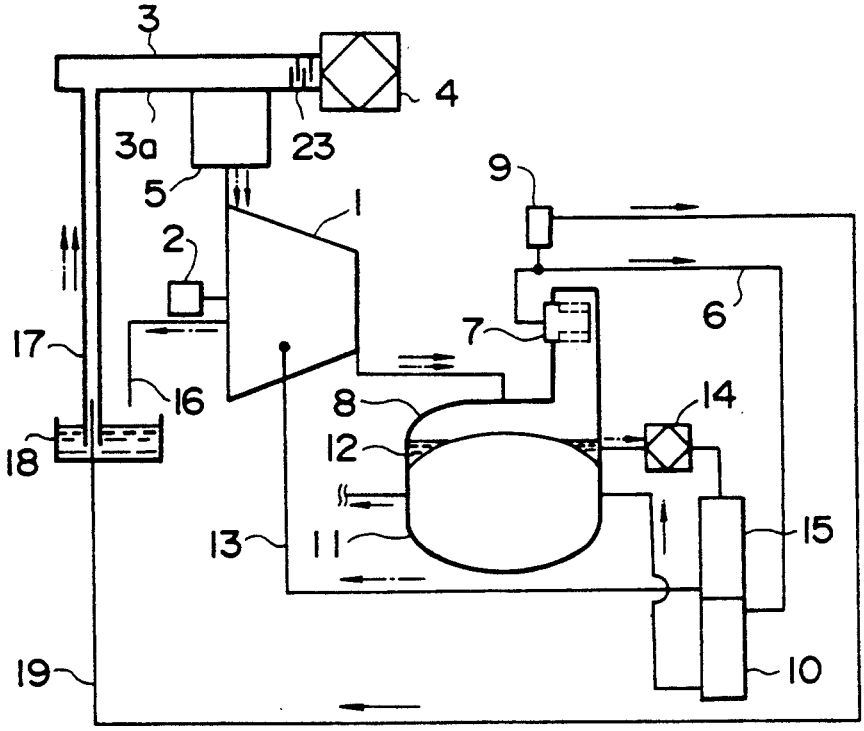
FIG. 6 is a general block diagram of the oil-cooled compressor of the second embodiment according to the first invention.

It should be noted that a labyrinth 23 may be adopted as a means of oil separation as shown in FIG. 6.

Furthermore, in the second invention, the means of oil separation of the construction shown in FIGS. 3 and 4 may be adopted.

As is apparent from the explanation given above, according to the first invention, the oil-cooled compressor having the suction control valve in the suction passage of the compressor body and the air discharge valve in the discharge passage is formed by providing an oil discharge passage for leading outside the lubricating oil supplied to bearing and shaft seal sections in the compressor, an oil return passage communicating with the inlet side of the suction control valve, an oil reservoir section between the oil discharge passage and the oil return passage, and an air discharge passage arranged with its one end connected to the outlet port of the air discharge valve and its another end reaching the oil reservoir section so that the lubricating oil can be sent out towards the inlet side of the suction control valve in the oil return passage without reverse flow into the oil discharge passage.

Therefore the equipment and its periphery will not become dirty with leaking oil. Moreover the compressor is designed such that lubrication oil will be effectively reused by recirculation without being discarded, thereby enabling reduction of running cost and dispensing with maintenance work for refilling the lubricating oil.

Furthermore, according to the second invention, the oil-cooled compressor having the suction control valve in the suction passage in the compressor body and the air discharge valve in the discharge passage is formed by providing an oil discharge passage for leading outside the lubricating oil supplied to bearing and shaft seal sections of the compressor, an oil return passage communicating with the extended section extending on the opposite side of the suction filter of the suction passage extending from the suction filter mounted on the inlet side of the suction control valve to the suction control valve, an oil separating means mounted between the suction control valve and the suction filter, an oil reservoir section between the oil discharge passage and the oil return passage, and an air discharge passage arranged with its one end connected to the outlet port of the air discharge valve and its another end reaching the oil reservoir section to send out the lubricating oil towards the inlet side of the suction control valve in the oil return passage without reversely flowing the oil from the oil reservoir section into the oil discharge passage.

The oil-cooled compressor, therefore, has the following advantage, in addition to the advantage of the first invention, that it is possible to prevent oil leakage from the suction filter out of the compressor by trapping the oil by the soil separating means if the oil tends to flow towards the filter side due to insufficient separation of discharge air from the oil from the oil return passage.

While the present invention has been particularly shown and described with reference to preferred embodiments thereof, it will be understood by those skilled in the art that the foregoing and other changes in form and details can be made therein without departing from the spirit and scope of the invention.

What is claimed is:

1. An oil cooled compressor comprising:

a compressor body having bearing and shaft seal sections;

an air suction passage connected to said compressor body;

an air discharge passage connected to said compressor body;

a suction control valve in said air suction passage;

an air discharge valve in said air discharge passage;

an oil discharge passage connected to said compressor body for leading oil from said bearing and shaft seal sections out of said compressor body;

an oil return passage connected to an inlet side of said suction control valve;

an oil reservoir section connected between said oil discharge passage and said oil return passage; and an air discharge passage connected between said air discharge valve and said oil reservoir section, whereby lubricating oil can flow through said oil return passage, toward the inlet side of said suction control valve without reverse flow of oil in said oil reservoir section into said oil discharge passage.

2. An oil cooled compressor comprising:

a compressor body having bearing and shaft seal sections;

an air suction passage connected to said compressor body;

an air discharge passage connected to said compressor body;

a suction control valve in said air suction passage;

an air discharge valve in said air discharge passage;

an oil discharge passage connected to said compressor body for leading oil from said bearing and shaft seal sections out of said compressor body;

a suction filter connected to an inlet side of said suction control valve via an oil separator, said suction filter having an upstream extended section;

an oil return passage connected to said extended section;

an oil reservoir section connected between said oil discharge passage and said oil return passage; and an air discharge passage connected between said air discharge valve and said oil reservoir section, whereby lubricating oil can flow through said oil return passage, toward the inlet side of said suction control valve without reverse flow of oil in said oil reservoir section into said oil discharge passage.

3. The compressor of claim 1 including a check valve at a junction of said oil return passage and said oil discharge passage in said oil reservoir section.

4. The compressor of claim 2 including a check valve at a junction of said oil return passage and said oil discharge passage in said oil reservoir section.

* * * * *